US006117248A

United States Patent [19]

Greenwood et al.

[11] Patent Number: 6,117,248

[45] Date of Patent: Sep. 12, 2000

[54] CLEANING RADIOACTIVELY CONTAMINATED MATERIAL

[75] Inventors: Howard Greenwood; Ismail Tahera Docrat; Alan Rushton, all of Preston, United Kingdom

[73] Assignee: British Nuclear Fuels plc, Warrington, United Kingdom

[21] Appl. No.: 09/117,503

[22] PCT Filed: Jan. 29, 1997

[86] PCT No.: PCT/GB97/00253

§ 371 Date: Jul. 30, 1998

§ 102(e) Date: Jul. 30, 1998

[87] PCT Pub. No.: WO97/28539

PCT Pub. Date: Aug. 7, 1997

[30] Foreign Application Priority Data

Jan. 31, 1996 [GB] United Kingdom ..... 9601956

[51] Int. Cl.[7] ..... B08B 3/04; B08B 3/06; B08B 3/08

[52] U.S. Cl. ..... 134/28; 134/26; 134/32; 134/33; 134/121

[58] Field of Search ..... 134/26, 28, 32, 134/33, 121, 95.1; 8/150; 68/213, 235 R

[56] References Cited

U.S. PATENT DOCUMENTS 5,434,332 7/1995 Cash .

FOREIGN PATENT DOCUMENTS

| | | |
|---|---|---|
| 2 694 210 | 2/1994 | France . |
| 36 31 278 | 3/1988 | Germany . |
| 3-063599 | of 1991 | Japan . |
| 2 038 885 | 7/1980 | United Kingdom . |
| 2 195 491 | 4/1988 | United Kingdom . |
| 2 269 119 | 2/1994 | United Kingdom . |

OTHER PUBLICATIONS

Database WPI Week 9117, Derwent Publications Ltd., London, GB & JP 03 063 599, Mar. 19, 1991.

*Primary Examiner*—Zeinab El-Arini
*Attorney, Agent, or Firm*—Nixon & Vanderhye

[57] ABSTRACT

Radioactively contaminated material is cleaned by placing the material in a permeable container, such as a bag, and inserting the container into an apertured, rotatable vessel. The material is then subjected within the rotating vessel to a leaching cycle, using nitric acid, and a washing cycle, using fresh water. Preferably, at least one further washing cycle is employed. After discharging the washing liquid, the material is subjected to a spin-drying operation. The material undergoing cleaning is a filter medium which includes a glass component.

19 Claims, 2 Drawing Sheets

CLEANING RADIOACTIVELY CONTAMINATED MATERIAL

The present invention relates to a method and apparatus for cleaning radioactively contaminated material. In particular, but not exclusively, the invention relates to the cleaning of radioactively contaminated filter media containing a glass component in order to render the media suitable for disposal.

BACKGROUND OF THE INVENTION

Before consignment of radioactively contaminated material to a waste disposal facility, for example, a waste landfill site, the contamination on the material must be reduced to below the specified disposal limits of the facility. It is therefore necessary to treat certain materials before disposal in order to ensure that the contamination levels are within the disposal limits.

One known method of treatment includes incineration of the materials. However, a problem has arisen particularly regarding the incineration of used filter media made of or including borosilicate glass fibres contaminated with uranium. Filters having filter media of this type, for example, High Efficiency Particulate Air (HEPA) filters, are used in ventilation systems installed in nuclear fuel processing facilities. The presence of the borosilicate glass fibres results in the encapsulation of uranium during incineration, making it difficult to leach out the uranium from the incinerated product.

It is an object of this invention to provide a method and apparatus for cleaning radioactively contaminated material whereby said material is decontaminated sufficiently to allow safe disposal thereof. It is a particular object of this invention to treat a radioactively contaminated filter medium made of or including glass fibres to render the medium suitable for safe disposal.

BRIEF SUMMARY OF THE INVENTION

According to the invention there is provided a method of cleaning a material contaminated with radioactive substances, the method comprising the steps of inserting said material into a container having one or more apertures, placing the container and the material into a rotatable vessel having one or more apertures, subjecting the material to a leaching cycle comprising supplying a leaching liquid to the inside of said vessel and rotating said vessel whereby said leaching liquid mixes with the contaminated material to dissolve the radioactive substances, terminating the rotation of said vessel and discharging the leaching liquid therefrom, and then subjecting the material to a washing cycle comprising supplying a washing liquid to the inside of the vessel and rotating said vessel to enable the washing liquid to mix with the material, terminating the rotation of the vessel and then discharging the washing material therefrom.

Preferably the material is subjected to at least one further washing cycle.

The material may be subjected to three washing cycles.

Advantageously, the method further includes the step of subjecting the material to a spin-drying operation after discharging the washing liquid from the vessel, comprising rotating the vessel so as to subject the material to a centrifugal force whereby excess liquid is ejected from the material.

A spin-drying operation may be carried out after discharging the leaching liquid from the vessel.

The contaminated material preferably comprises a filter medium which includes a glass component.

The material to be cleaned may be contaminated with radioactive uranium substances.

Preferably the leaching liquid comprises nitric acid and the washing liquid is preferably water.

According to a further aspect of the invention there is provided apparatus for cleaning radioactively contaminated material, said apparatus comprising a container having one or more apertures for receiving said material, a vessel having one or more apertures in which the container containing the material can be placed, drive means for rotating the vessel, means for supplying a leaching liquid to the interior of the vessel and means for supplying a washing liquid to the interior of the vessel.

Preferably the container for receiving the material is permeable.

Advantageously, the container comprises a permeable bag.

The vessel preferably comprises a hollow cylindrical drum.

Preferably a cylindrical wall of the drum is perforated by a plurality of holes.

Preferably the drum is mounted within a housing for rotation about a horizontal axis, the housing having an access opening normally closed by a door which is located adjacent to an open end of the drum.

The apparatus may include a first tank for holding the leaching liquid and a second tank for holding the washing liquid, and pump means for supplying the leaching and washing liquids from said first and second tanks to the interior of the drum.

Further pump means may be provided for discharging said leaching and washing liquids from the interior of the drum to said first and second tanks.

Preferably the pump means comprises a pneumatically-operated diaphragm pump.

Radiation detection means may be provided in the vicinity of the drum for monitoring the radioactivity of the material within the drum.

BRIEF DESCRIPTION OF THE DRAWINGS

Embodiments of the invention will now be described, by way of example, with reference to the accompanying drawings, in which.

DETAILED DESCRIPTION OF THE PREFERRED EMBODIMENT

The invention is particularly suitable, although not exclusively, for the cleaning of filter media which may be contaminated with uranium. Such filter media may have been included in filters of the type known as High Efficiency Particulate Air (HEPA) filters which have been used, for example, in ventilation systems for buildings in which radioactive uranium is processed or present. Filters of the type known as prefilters can also be treated in accordance with the present invention.

A typical HEPA filter comprises a square or circular casing made from chipboard or plywood and, within the casing, a filter medium formed from sheets of borosilicate fibres interleaved with paper spacing sheets. Some types of HEPA filter are provided with plastic grilles. Prefilters have a similar construction but the casing is made from cardboard.

Before subjecting a HEPA filter contaminated with uranium to the cleaning treatment, the filter medium is removed from the casing. The casing, and plastic grilles if present, can be subjected to a jet washing operation to render them suitable for direct disposal. The removed filter medium is divided into sections and placed in an apertured container, preferably a permeable polyester bag, which is then closed by fitting cable ties. A suitable weight of the filter medium in the bag can be in the region of 2.5 kilograms. Prefilters can be loaded directly into the permeable bags without removal of the filter medium from the cardboard casing. If the prefilters are broken up or folded, three of them can be accommodated in one bag.

Figure 1:
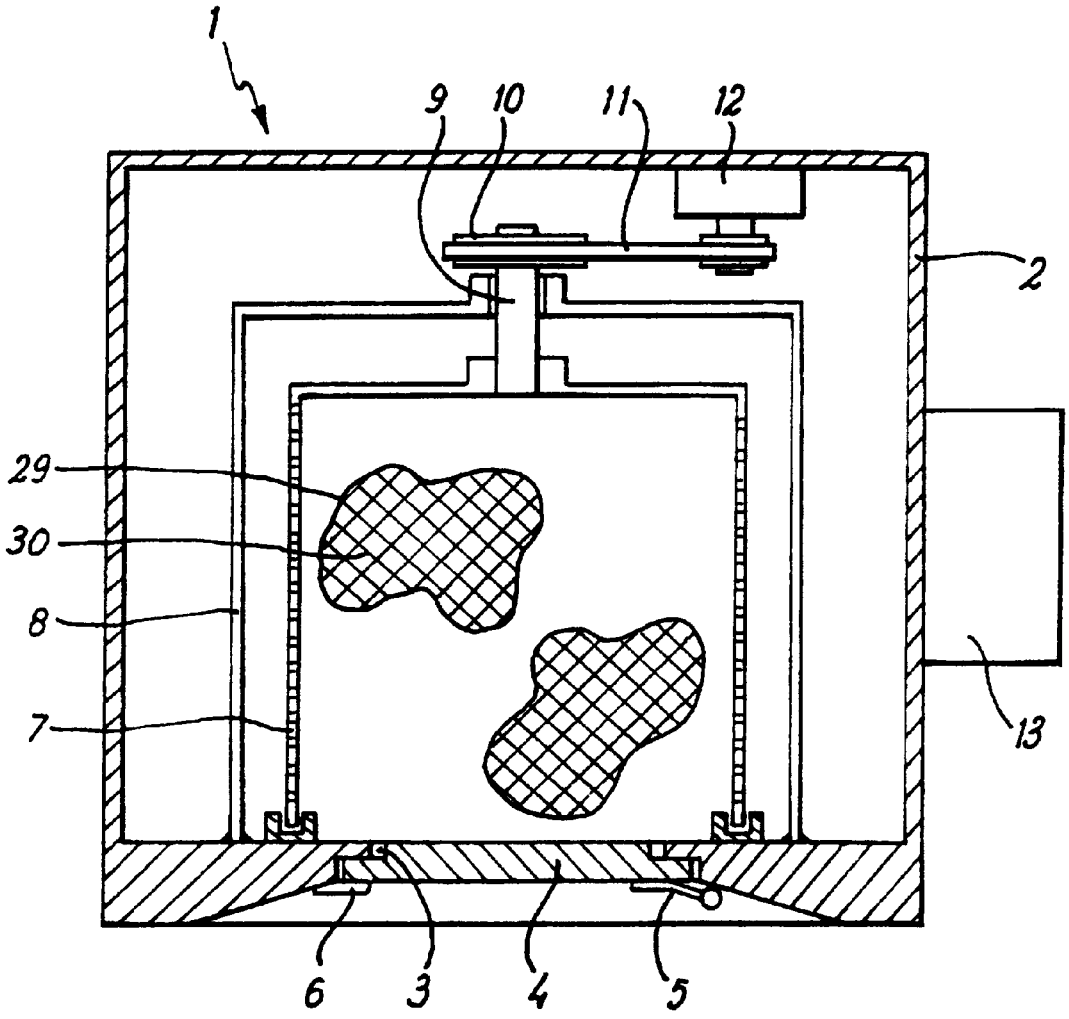
FIG. 1 is a diagrammatic cross-sectional plan view of a machine for cleaning radioactively contaminated material.

Referring now to FIG. 1, a cleaning machine 1 is shown diagrammatically which is suitable for treating the filter medium. The machine 1 comprises a housing 2 having an access opening 3 normally closed by a door 4 which is pivotably mounted at 5 and has a lockable fastening device 6. Seals are provided to ensure that the door 4 is watertight when closed. Interlocks ensure that the door cannot be opened when the machine 1 is in operation. Inside the housing 2 is a cylindrical vessel, preferably a drum 7, having a cylindrical wall perforated by a plurality of holes and arranged for rotation about a horizontal axis within a stationary cylindrical casing 8. Preferably, the drum 7 and the casing 8 are made from stainless steel. The drum 7 has an open end adjacent to the door 4 and is fixedly mounted on a shaft 9 which extends rearwardly through the outer casing 8. A driven pulley 10, mounted on the end of the shaft 9, is rotated by a driving belt 11. Movement of the driving belt 11, and hence rotation of the drum 7, is derived from a drive assembly 12 which may comprise an electric motor and gearbox having a variable speed output. It will be appreciated that other types of variable speed driving arrangements for the drum could be used. A radiation measuring instrument 13, for example, a gamma radiation monitor, may be fitted to the outside of the housing 2.

Figure 2:
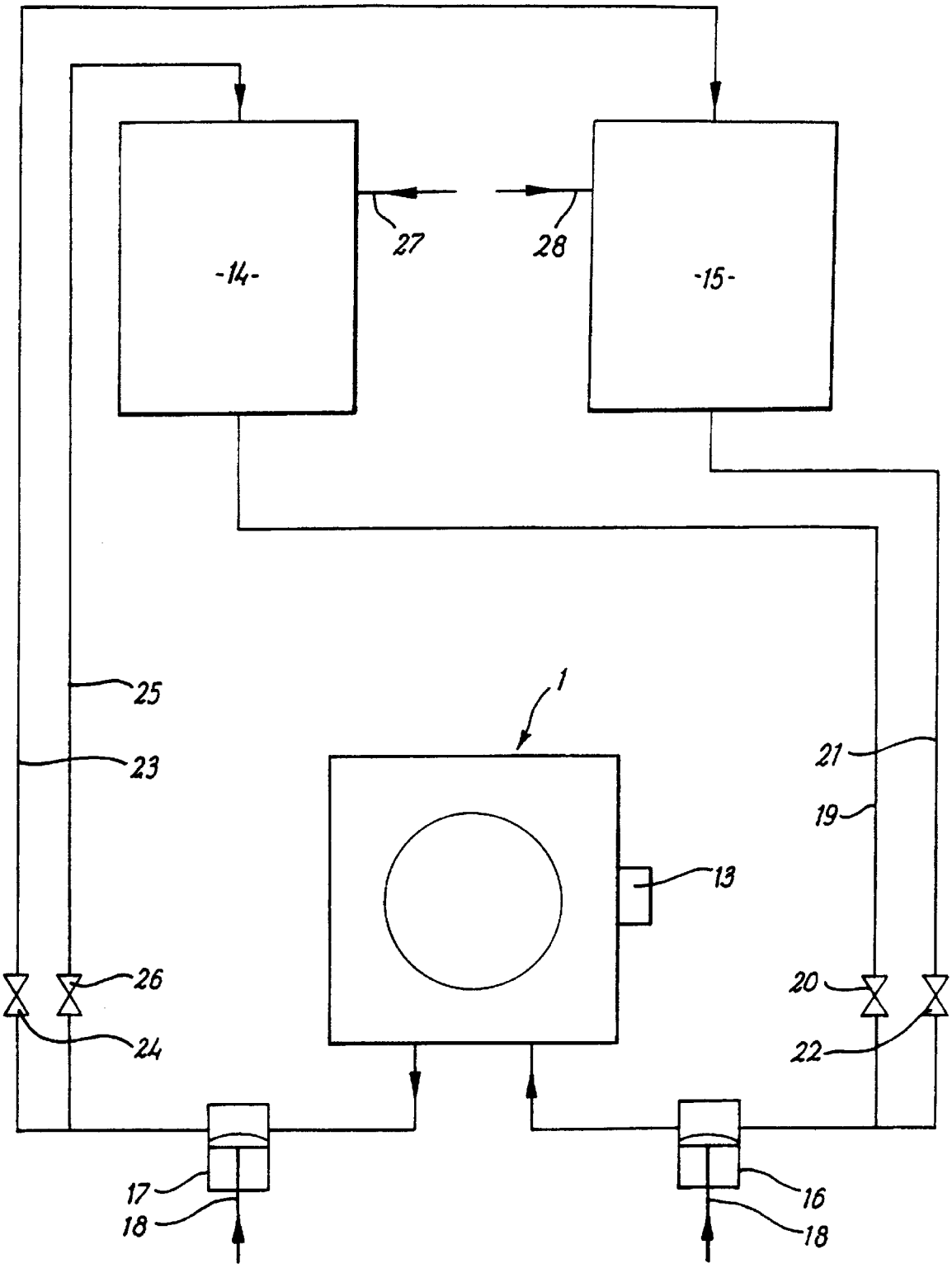
FIG. 2 is a schematic layout of a cleaning apparatus incorporating the machine shown in FIG. 1.

A schematic layout of a simplified pipework system is shown in FIG. 2 in which the cleaning machine 1 is connected to a tank 14 containing a leaching liquid, and a tank 15 containing a washing liquid. Preferably, the leaching liquid comprises nitric acid and the washing liquid is fresh water. The machine 1 is equipped with a supply pump 16 and a discharge pump 17. Each of the pumps 16, 17 is preferably of the type comprising a stainless steel, double-diaphragm pump operated by compressed air supplied through lines 18. The supply pump 16 is connected by a pipe 19, provided with a valve 20, to the nitric acid tank 14 and by a pipe 21, equipped with a valve 22, to the water tank 15. similarly, the discharge pump 17 is connected by a pipe 23, provided with a valve 24, to the water tank 15 and to the nitric acid tank 14 by a pipe 25 having a valve 26. Nitric acid can be supplied to the tank 14 through a pipe 27 and water can be supplied to the tank 15 through a pipe 28.

In use, the door 4 is opened and a permeable bag 29 containing a filter medium 30 is inserted through the access opening 4 into the drum 7. Several bags 29 may be placed in the drum 7 to form a typical load of approximately 22 kilograms. The door 4 is then closed and locked and it is ensured that the valve 20 is open and that the valves 22, 24 and 26 are closed. A leaching cycle is then initiated by supplying compressed air through the line 18 to the diaphragm pump 16 which operates to pump nitric acid from the tank 14 through the pipe 19 and the open valve 20 into the machine 1. The nitric acid is directed into the casing 8 and passes through the perforated wall of the drum 7. After stopping the supply of nitric acid to the machine 1, the drive assembly 12 is operated to cause rotation of the drum 7 at, say, 30 rpm. The permeability of the bag 29 allows the nitric acid to act on the filter medium 30, but the bag will prevent the material, which is formed into a pulp consistency by the nitric acid, from blocking the apertures in the drum 7. Rotation of the drum 7 promotes intimate mixing of the nitric acid and the filter medium so that efficient dissolution of the uranium substances can occur within a short period of time. We have found that a satisfactory concentration for the nitric acid is 4M. If desired, the drum 7 may be rotated for a period in the opposite direction, or in successive alternate clockwise and anti-clockwise directions, to enhance the mixing of the nitric acid with the filter medium. After a period of time, say, 15–90 minutes, rotation of the drum 7 is stopped and the pump 17 is operated to pump the nitric acid from the machine 1 to the tank 14 through the pipe 25 and the valve 26, now open. The drum 7 is then rotated at a high speed, for example at 400 rpm to subject the material to a spin-drying operation by ejecting further nitric acid from the filter material, the ejected nitric acid then being pumped to the tank 14.

A washing cycle is then started by operating the pump 16 with the valve 20 closed and the valve 22 open. Water is thus delivered from the tank 15 through the pipe 21 to the machine 1. By operation of the drive assembly 12 the drum is rotated at, say 30 rpm so that the water intimately mixes with the filter medium 30 and washes out the dissolved uranium substances which have remained in the medium following the nitric acid leaching cycle. After a period of time, typically 15 minutes, rotation of the drum 7 is stopped and, with the valve 24 open and the valve 26 closed, the pump 17 is operated to return the water to the tank 15 through the pipe 23. If required, the washing cycle may be repeated. We have found, in practice, that three washing cycles produces satisfactory results.

The drum 7 is then rotated at a high speed, typically 400 rpm, so as to subject the filter medium 30 to a spin-drying process whereby excess moisture is ejected from the medium. Preferably the drum 7 is rotated at a speed sufficient to subject the filter medium to a centrifugal force in the region of 150 g. Following the spin-drying operation the bag 29 containing the dried, treated medium can be removed from the machine 1.

The radioactivity of the contents of the machine 1 can be measured by the gamma monitor 13. Before removal of the bags 29 from the machine the gamma monitor 13 can be used to check whether the treated filter medium has been cleaned sufficiently to permit safe disposal. If desired, a separate monitoring station can be provided for checking the contamination level of the treated filter medium.

In practice, the operating sequence and duration of the operation of the pumps, valves and drive means are carried out automatically in accordance with a predetermined programme. Variations in the cycle times can be effected by modifying the programme.

If desired, the apparatus described above can be utilised to decontaminate material other than filter media. Such material may include items comprising contaminated gloves, textiles and paper, etc.

What is claimed is:

1. A method of cleaning a material contaminated with radioactive substances comprising the steps of:

(1) inserting said contaminated material into a container having one or more apertures;

(2) placing the container and te material into a rotatable vessel having one or more apertures;

(3) subjecting the contaminated material to a leaching cycle comprising supplying a leaching liquid to inside of said vessel and rotating said vessel whereby said leaching liquid mixes with the contaminated material to dissolve the radioactive substances;

(4) terminating the rotation of said vessel and discharging the leaching liquid therefrom; and then (5) subjecting the leached material to a washing cycle comprising supplying a washing liquid to inside of the vessel and rotating said vessel to enable the washing liquid to mix with the material;

(6) terminating the rotation of the vessel; and then (7) discharging the washing liquid therefrom.

2. The method according to claim 1, wherein the washed material is subjected to at least one further washing cycle.

3. The method according to claim 1, wherein the washed material is subjected to three washing cycles.

4. the method according to claim 1 further including the step of subjecting the washed material to spin-drying after discharging the washing liquid from the vessel by rotating the vessel so as to subject the material to a centrifugal force whereby liquid is ejected from the material.

5. The method according to claim 4, further including the step of subjecting the washed material to spin-drying after discharging the leaching liquid from the vessel.

6. The method according to claim 1 wherein the contaminated material comprises a filter medium which includes a glass component.

7. The method according to claim 1 wherein the material is contaminated with radioactive uranium substances.

8. The method according to claim 1 wherein the leaching liquid comprises nitric acid.

9. The method according to claim 1 wherein the washing liquid comprises water.

10. An apparatus for cleaning radioactively contaminated material, the apparatus comprising a container (29) having an interior and one or more apertures for receiving the contaminated material;

a vessel (7) having one or more apertures therein in which the container (29) containing the contaminated material (30) can be placed;

drive means (12) for rotating the vessel (7);

means (14, 19, 16) for supplying a leaching liquid to the interior of the vessel (7) and;

means (15, 21 16) for supplying a washing liquid to the interior of the vessel.

11. The apparatus according to claim 10, wherein the container (29) for receiving the material is permeable.

12. The apparatus according to claim 10, wherein the container comprises a permeable bag (29).

13. The apparatus according to claim 12 wherein the vessel comprises a hollow cylindrical drum (7).

14. The apparatus according to claim 13, wherein a cylindrical wall of the drum (7) is perforated by a plurality of holes.

15. The apparatus according to claim 13 or 14, wherein the drum (7) is mounted within a housing (8) for rotation about a horizontal axis, the housing (8) having an access opening (3) normally closed by a door (4) which is located adjacent an open end of the drum (7).

16. The apparatus according to claim 13 further comprising a first tank (14) for holding the leaching liquid and a second tank (15) for holding the washing liquid, and a pump (16) for supplying the leaching and washing liquids from the first and second tanks to the interior of the drum.

17. The apparatus according to claim 16, wherein a further pump (17) is provided for discharging leaching and washing liquids from the interior of the drum (7) to said first and second tanks.

18. The apparatus according to claim 16 or 17, wherein the pumps (16, 17) are pneumatically-operated diaphragm pumps.

19. The apparatus according to claim 13, wherein radiation detection means (13) are provided adjacent the drum (7) for monitoring radioactivity of the contaminated material (30) within thc drum.

* * * * *